US008197241B2

(12) United States Patent
Robisson et al.

(10) Patent No.: US 8,197,241 B2
(45) Date of Patent: Jun. 12, 2012

(54) NANOCOMPOSITE MOINEAU DEVICE

(75) Inventors: Agathe Robisson, Cambridge, MA (US); Hossein Akbari, Bristol (GB); Julien Ramier, Cheltenham (GB); Olivier Sindt, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 668 days.

(21) Appl. No.: 11/959,353

(22) Filed: Dec. 18, 2007

(65) Prior Publication Data

US 2010/0098569 A1 Apr. 22, 2010

(51) Int. Cl.

| | |
|---|---|
| ***F03C 4/00*** | (2006.01) |
| ***F04C 15/00*** | (2006.01) |
| ***F04C 2/00*** | (2006.01) |
| ***F04C 29/00*** | (2006.01) |

(52) U.S. Cl. ..... 418/152; 418/48; 418/153

(58) Field of Classification Search ..... 418/48, 418/152, 153, 178, 179

See application file for complete search history.

(56) References Cited

U.S. PATENT DOCUMENTS

| | | | | |
|---|---|---|---|---|
| 5,735,436 | A * | 4/1998 | Schroeder et al. | 418/48 |
| 5,759,019 | A * | 6/1998 | Wood et al. | 418/48 |
| 6,183,226 | B1 | 2/2001 | Wood et al. | |
| 6,543,132 | B1 | 4/2003 | Krueger et al. | |
| 7,083,401 | B2 | 8/2006 | Hooper | |
| 7,316,789 | B2 | 1/2008 | Lu | |
| 7,604,049 | B2 | 10/2009 | Vaidya et al. | |
| 2004/0258548 | A1 * | 12/2004 | Zitka et al. | 418/48 |
| 2005/0089429 | A1 | 4/2005 | Delpassand et al. | |
| 2005/0116336 | A1 | 6/2005 | Chopra et al. | |
| 2006/0216178 | A1 * | 9/2006 | Sindt et al. | 418/48 |
| 2009/0152009 | A1 * | 6/2009 | Slay et al. | 418/178 |

FOREIGN PATENT DOCUMENTS

WO 2005014708 A1 2/2005

OTHER PUBLICATIONS

Levi et al., Properties of Polyvinylidene Difluoride—Carbon Nanotubes Blends, vol. 4, No. 7, Jun. 16, 2004, pp. 1267-1271.*

Underhill et al, "Carbon nanotube-elastomer composites for use in dielectric polymer actuators", IEEE Computer Society, Proceedings of the 2005 International Conference on MEMS, NANO and Smart Systems, 2005, 2 pages.

"High-temperature range polymer-skinned drill motor", publication date Jul. 27, 2006, url: http://priorartdatabase.com/IPCOM/000138623.

Choi et al., Anomalous thermal conductivity enhancement in nanotube suspensions, Applied Physics Letters, 2001, vol. 79, No. 14, pp. 2252-2254.

Biercuk et al., Carbon nanotube composites for thermal management, Applied Physics Letters, 2002, vol. 80, No. 15, pp. 2767-2769.

* cited by examiner

*Primary Examiner* — Theresa Trieu

(57) ABSTRACT

A Moineau device includes a stator that interfaces to a rotor whereby fluid flows through cavities between the stator and rotor that progress axially as the rotor is rotated relative to the stator. At least one of the stator and the rotor is realized from a nanocomposite that includes a polymeric matrix with carbon nanotubes dispersed therein.

17 Claims, 4 Drawing Sheets

NANOCOMPOSITE MOINEAU DEVICE

BACKGROUND OF THE INVENTION

1. Field of the Invention

This invention relates broadly to Moineau devices in which a helical profiled rotor acts in conjunction with a helical profiled stator as a motor or a pump, and more specifically to the use of polymer materials for such Moineau devices.

2. Related Art

Moineau devices (sometimes referred to as progressive cavity devices) typically include a power section that includes a rotor with a profiled helical outer surface disposed within a stator with a profiled helical inner surface. The helical outer surface of the rotor sealably engages the helical inner surface of the stator to create cavities which progress axially as the rotor is rotated relative to the stator. In a Moineau pump, relative rotation is provided between the stator and the rotor which causes fluids (and possibly solids suspended therein) to be passed through the cavities of the device. In a Moineau motor, a fluid source is provided to the cavities of the device which causes the cavities to progress and induce relative motion between the stator and the rotor. Moineau pumps and motors have many uses. For example, a Moineau motor is often used in hydrocarbon extraction applications for drilling a subterranean well bore by applying drilling mud under pressure to the cavities of the motor, which induces relative motion between the stator and the rotor that is used to power a drill bit for drilling the well bore.

Conventional Moineau devices employ a steel rotor and an elastomeric material bonded to steel for the stator. The elastomeric material of the stator can be natural rubber, G.R.S., Neoprene, Butyl and Nitrile rubbers, soft PVC, fluoroelastomers, etc. The elastomeric material of the stator is required to be soft enough to maintain the sealed cavity, yet be hard enough to withstand the abrasive wear from the working contact between the rotor and the stator.

SUMMARY OF THE INVENTION

The present invention provides for materials and methods of manufacture for a Moineau device. The materials comprise a nanocomposite which includes a polymeric matrix with carbon nanotubes (e.g., single-walled carbon nanotubes, multi-walled carbon nanotubes) dispersed therein. In the preferred embodiment, the nanocomposite is part of the stator of the Moineau device and defines the profiled helical inner surface that sealably engages the rotor of the Moineau device. The nanocomposite can also be used to realize other components of the Moineau device, such as a portion of the rotor of the device.

According to one aspect of the invention, the carbon nanotubes of the nanocomposite material provide good thermal conduction. Thus, in portions of the stator and/or rotor of the Moineau device where local temperatures can increase and accelerate material degradation, the nanocomposite material is used such that the thermal conduction of the nanocomposite material will counteract the local build-up of heat. As a result, the Moineau device will be maintained at a temperature closer to average temperature of the environment and therefore will maintain better mechanical properties over time. The operational lifetime of the nanocomposite structure is also improved.

According to another aspect of the invention, the carbon nanotubes of the nanocomposite material provide improved mechanical properties (such as stiffness, tensile strength, visco-elasticity (e.g., heat dissipation due to physical interactions between the carbon nanotubes of the nanocomposite material)) of the stator and/or rotor of the Moineau device.

In another aspect, a method of manufacturing a stator of a Moineau device disposes a mandrel with a desired helical profile within a cylindrical casing. A void disposed between the mandrel and the cylindrical casing is filled with a nanocomposite material which includes a polymeric matrix with carbon nanotubes dispersed therein. The nanocomposite is cured. Subsequent to curing, the mandrel is removed from within the cylindrical casing. A bonding agent can be applied to the internal surface of the cylindrical casing to aid in bonding the nanocomposite material to the cylindrical casing. A release agent can be applied to the mandrel to aid in releasing the mandrel from the nanocomposite material. The nanocomposite material can be molded as part of a support structure underlying a resilient liner. In an alternate embodiment, the nanocomposite material can be molded as part of a resilient liner that defines the profiled helical inner surface of the stator.

DETAILED DESCRIPTION OF THE PREFERRED EMBODIMENT

Figure 1:
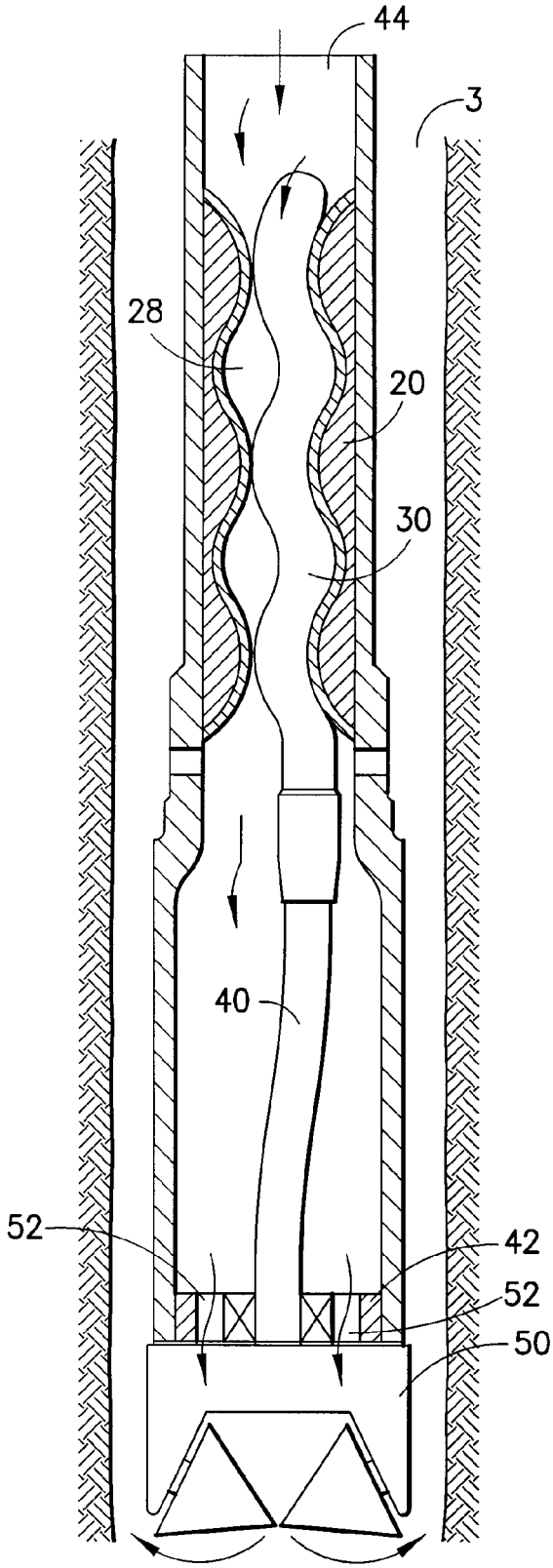
FIG. 1 is a schematic view of a Moineau motor configured for downhole drilling.

FIG. 1 depicts a Moineau motor suspended within a borehole 3 and used for downhole drilling. The Moineau motor includes a stator 20 that interfaces to a corresponding rotor 30 that is connected to a flexshaft 40, which is supported by bearings 42 as needed. The flexshaft 40 drives a drill bit 50. Drilling fluid (typically referred to as "mud" and shown as arrows in FIG. 1) is supplied under pressure to the inlet 44 of the motor. The fluid flows through cavities 28 between the stator 20 and rotor 30 that progress axially as the rotor 30 is rotated relative to the stator 20. The fluid exits through or around drill bit 50 via ports 52. The flex shaft 40 and bearings 42 translates the rotation and gyration of rotor 30 to true rotary motion of shaft 40, which is imported to the drill bit 50. Other suitable transmission devices (such as universal joints) can be used to mechanically couple the rotor 30 to the drill bit 50.

In accordance with the present invention, the stator 20 of FIG. 1 is realized from a nanocomposite material which includes a polymeric matrix with carbon nanotubes dispersed therein. The carbon nanotubes can be single-walled carbon nanotubes or multi-walled carbon nanotubes. In the preferred embodiment, the nanocomposite material includes carbon nanotubes in a range from 2% to 40% by weight. The nanocomposite material is used for portions of the stator of the Moineau device where local temperatures can increase and accelerate degradation. The carbon nanotubes of the nanocomposite material provide improved mechanical properties (such as stiffness, tensile strength, visco-elasticity) as well as improved thermal conduction which minimizes localized high temperatures zones. The nanocomposite material of the stator can be formed by a variety of methods, including molding and/or machining and thus can be adapted to a variety of motor uses and environments.

The polymeric matrix of the nanocomposite material can be realized from one or more polymers selected from natural and synthetic polymers, including those listed in ASTM D1600-92, "Standard Terminology for Abbreviated Terms Relating to Plastics," and ASTM D1418 for nitrile rubbers, blends of natural and synthetic polymers, and layered versions of polymers, wherein individual layers may be the same or different in composition and thickness. The term matrix as used herein is not meant to exclude any particular form or morphology for the polymeric component and is used merely as a term of convenience in describing the apparatus of the invention. The polymeric matrix of the nanocomposite material can include other materials, such as, but not limited to, fillers (e.g., metal fillers, ceramic fillers, silica fillers, carbon black), plasticizers, and fibers. The polymeric matrix may comprise one or more thermoplastic polymers, such as polyolefins, polyimides, polyesters, polyetheretherketones (PEEK), thermoplastic polyurethanes and polyurea urethanes, copolymers, and blends thereof, and the like; one or more thermoset polymers, such as phenolic resins, epoxy resins, and the like, and/or one or more elastomers (including natural and synthetic rubbers), and combinations thereof.

The polymeric matrix of the nanocomposite material can be realized from one or more elastomers. An elastomer as used herein is a generic term for a substance emulating natural rubber in that it stretches under tension, has a high tensile strength, retracts rapidly, and substantially recovers its original dimensions. Elastomers are made with polymer chains with different lengths. Each chain is typically made of thousands of units (monomers). Cohesion is provided by molecular entanglements and physical bonds between chains. Elasticity is provided by crosslinking, which are chemical bonds typically involving sulfur or peroxides. The term includes natural and man-made elastomers, and the elastomer may be a thermoplastic elastomer or a non-thermoplastic elastomer. The term includes blends (physical mixtures) of elastomers, as well as copolymers, terpolymers, and multi-polymers. Examples include ethylene-propylene-diene polymer (EPDM), various nitrile rubbers which are copolymers of butadiene and acrylonitrile such as Buna-N (also known as standard nitrile and NBR), carboxylated high-acrylonitrile butadiene copolymers (XNBR), and hydrogenated versions of these copolymers (HNBR). Other useful elastomers include polyvinylchloride-nitrile butadiene (PVC-NBR) blends, chlorinated polyethylene (CM), chlorinated sulfonate polyethylene (CSM), aliphatic polyesters with chlorinated side chains such as epichlorohydrin homopolymer (CO), epichlorohydrin copolymer (ECO), and epichlorohydrin terpolymer (GECO), polyacrylate rubbers such as ethylene-acrylate copolymer (ACM), ethylene-acrylate terpolymers (AEM), EPR, elastomers of ethylene and propylene, sometimes with a third monomer, such as ethylene-propylene copolymer (EPM), ethylene vinyl acetate copolymers (EVM), fluorocarbon polymers (FKM), copolymers of poly (vinylidene fluoride) and hexafluoropropylene (VF2/HFP), terpolymers of poly(vinylidene fluoride), hexafluoropropylene, and tetrafluoroethylene (VF2/HFP/TFE), terpolymers of poly(vinylidene fluoride), polyvinyl methyl ether and tetrafluoroethylene (VF2/PVME/TFE), terpolymers of poly(vinylidene fluoride), hexafluoropropylene, and tetrafluoroethylene (VF2/HPF/TFE), terpolymers of poly(vinylidene fluoride), tetrafluoroethylene, and propylene (VF2/TFE/P), perfluoroelastomers such as tetrafluoroethylene perfluoroelastomers (FFKM), highly fluorinated elastomers (FEPM), butadiene rubber (BR), polychloroprene rubber (CR), polyisoprene rubber (IR), polynorbornenes, polysulfide rubbers (OT and EOT), polyurethanes (AU) and (EU), silicone rubbers (MQ), vinyl silicone rubbers (VMQ), fluoromethyl silicone rubber (FMQ), fluorovinyl silicone rubbers (FVMQ), phenylmethyl silicone rubbers (PMQ), styrene-butadiene rubbers (SBR), copolymers of isobutylene and isoprene known as butyl rubbers (IIR), brominated copolymers of isobutylene and isoprene (BIIR) and chlorinated copolymers of isobutylene and isoprene (CIIR).

Thermoplastic elastomers are generally the reaction product of a low equivalent molecular weight polyfunctional monomer and a high equivalent molecular weight polyfunctional monomer, wherein the low equivalent weight polyfunctional monomer is capable, on polymerization, of forming a hard segment (and, in conjunction with other hard segments, crystalline hard regions or domains) and the high equivalent weight polyfunctional monomer is capable, on polymerization, of producing soft, flexible chains connecting the hard regions or domains. Thermoplastic elastomers differ from thermoplastics and elastomers in that thermoplastic elastomers, upon heating above the melting temperature of the hard regions, form a homogeneous melt which can be processed by thermoplastic techniques (unlike elastomers), such as injection molding, extrusion, blow molding, and the like. Subsequent cooling leads again to segregation of hard and soft regions resulting in a material having elastomeric properties, however, which does not occur with thermoplastics. Commercially available thermoplastic elastomers suitable for realizing the polymeric matrix of the nanocomposite include segmented polyester thermoplastic elastomers, segmented polyurethane thermoplastic elastomers, segmented polyamide thermoplastic elastomers, blends of thermoplastic elastomers and thermoplastic polymers, and ionomeric thermoplastic elastomers.

The polymeric matrix of the nanocomposite material can also be realized from a thermoplastic material. A thermoplastic material is a polymeric material (preferably, an organic polymeric material) that softens and melts when exposed to elevated temperatures and generally returns to its original condition, i.e., its original physical state, when cooled to ambient temperatures. During manufacturing, the thermoplastic material may be heated above its softening temperature, and preferably above its melting temperature, to cause it to flow and form a desired shape. After the desired shape is formed, the thermoplastic substrate is cooled and solidified. In this way, thermoplastic materials (including thermoplastic elastomers) can be molded into various shapes and sizes. Moldable thermoplastic materials that may be used are those having a high melting temperature, good heat resistant properties, and good toughness properties. Examples of thermoplastic materials suitable for use in the polymeric matrix of the nanocomposite material include PEEK, polyaryletherketone (PAEK), polyetherketoneketone (PEKK), polyetherimide (PEI), polyphenylene (PES), polyphenylene sulfide (PPS). Other polymeric materials suitable for use in the polymeric matrix of the nanocomposite material include block copolymers (e.g., styrene-butadiene-styrene (SBS) rubber, copolyesters and polyureathanes), thermoplastic rubber combinations (e.g., ethylene propylene diene monomer (EPDM) rubber and polyphenylene ether (PPE), nitrile-butadiene rubber (NBR) and polyvinyl chloride, butyl rubber (IIR) and polypropylene (PP)).

The polymeric matrix of the nanocomposite material can also be realized from a thermoset material. A thermoset material is a polymeric material that hardens when exposed to elevated temperatures or otherwise cured. Once the material has been cured, it generally does not go back to its original state nor does it melt when reheated. Examples of thermoset materials suitable for use in the polymeric matrix of the nanocomposite include phenolic resins, epoxy resins, phenoxy, phenolic, ester, polyurethane, polyurea, and the like. Thermoset molding compositions known in the art can also be used, which generally include thermosetting resins containing inorganic fillers and/or fibers. Upon heating, thermoset monomers initially exhibit viscosities low enough to allow for melt processing and molding of an article from the filled monomer composition. Upon further heating, the thermosetting monomers react and cure to form hard resins with high stiffness. Non-limiting examples of suitable epoxies include the High Temperature Mould maker (C-1) liquid epoxy or other metal filled epoxies sold commercially by ITW-Devcon of Rushden, UK. Metal fillers typically used are steel, aluminum and/or titanium. Another non-limiting example of a suitable epoxy is the polycarbon fiber ceramic filled Novolac™ resin sold commercially by Protech Centreform Ltd. of Aberdeen, Scotland.

For many applications, the polymeric matrix of the nanocomposite can be cross-linked in order to limit creep induced by stresses during device operation. Alternatively, the polymeric matrix of the nanocomposite can be a semi-crystalline polymer with a high degree of crystallinity.

Figure 2:
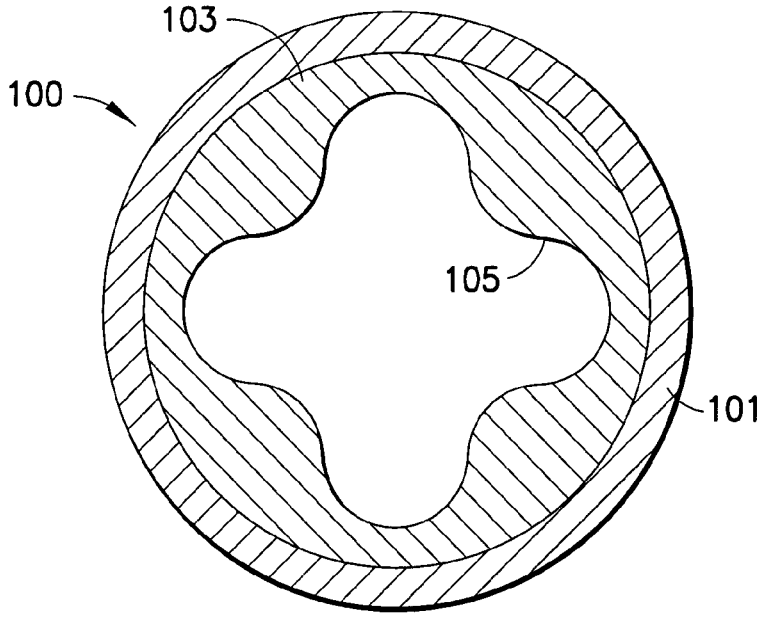
FIG. 2 is a cross-sectional view of an embodiment of the stator of the Moineau motor of FIG. 1 in accordance with the present invention.

FIG. 2 illustrates an embodiment of a stator 100 that includes a cylindrical casing 101 with a nanocomposite structure 103 bonded thereto. The cylindrical casing 101 is preferably realized from steel. The nanocomposite structure 103 defines a profiled helical inner surface 105 that sealably engages the profiled helical outer surface of the rotor (not shown) of the Moineau device. The nanocomposite material of the structure 103 provides improved mechanical properties (such as stiffness, tensile strength, visco-elasticity) as well as improved thermal conduction that minimizes localized high temperatures zones in the body of the structure 103. Note that the cross-section of FIG. 2 illustrates a stator with four lobes. Other multi-lobe configurations (typically from two to eight lobes) can be used.

The stator 100 is preferably formed by dispersing carbon nanotubes within a polymeric matrix by mixing to form the nanocomposite material. A bonding agent can be applied to the internal wall 106 of the cylindrical casing 101 (FIG. 5) if necessary. A mandrel 107 whose outer surface 108 defines the profiled helical inner surface 105 of the stator 100 is disposed within the cylindrical casing 101. The mandrel 107 is preferably realized from steel or other suitable material. The shape and dimensions of the mandrel 107 may account for expansion and/or shrinkage of the nanocomposite material while it is being processed. A release agent can be applied to the outer surface 108 of the mandrel 107. The mandrel 107 is used as a male mold core and the release agent avoids bonding of the nanocomposite material to the core. The nanocomposite material is added to the void 109 between the mandrel 107 and the cylindrical casing 101. When added to the void 109, the polymeric matrix of the nanocomposite material can be in one of many phases (i.e., a liquid, paste, powder or granules). The nanocomposite material is then cured to form the nanocomposite structure 103 and thereby impart the desired permanent helical profile to the nanocomposite structure 103. The curing can be accomplished by application of heat, radiation, steam or possibly cooling for thermoplastics. The mandrel 107 is then released from the nanocomposite structure 103 and removed from inside the cylindrical casing 101 to obtain the desired profiled helical inner surface 105 of the nanocomposite structure 103.

Figure 3:
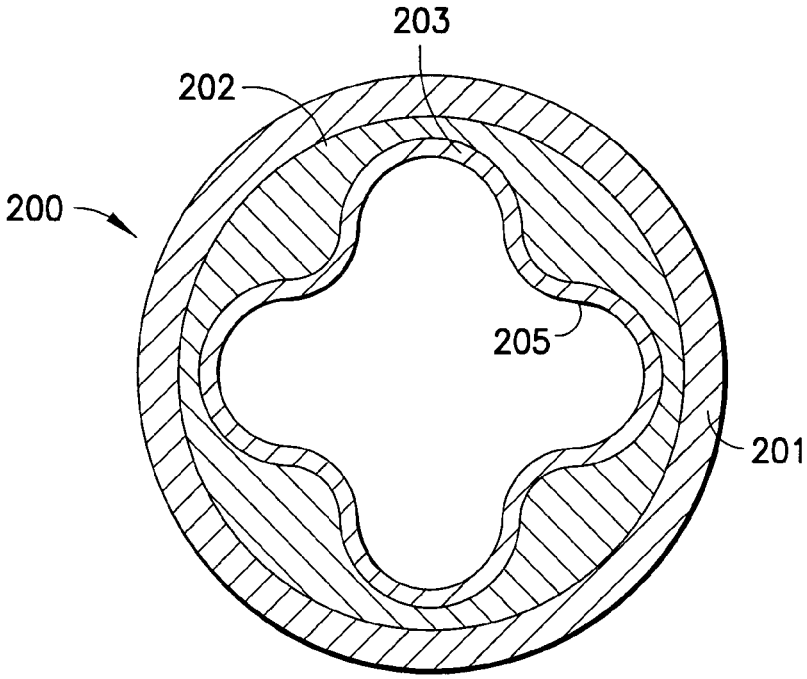
FIG. 3 is a cross-sectional view of another embodiment of the stator of the Moineau motor of FIG. 1 in accordance with the present invention.

FIG. 3 illustrates another embodiment of a stator 200 that includes a cylindrical casing 201, preferably realized from steel. A nanocomposite support structure 202 with an undersized profiled helical support surface is bonded to the cylindrical casing 201. A thin liner 203 is bonded to the profiled helical support surface of structure 202 and defines the profiled helical inner surface 205 that sealably engages the profiled helical outer surface of the rotor (not shown) of the Moineau device. The nanocomposite support structure 202 reinforces the liner 203 and provides improved mechanical properties (such as stiffness, tensile strength, visco-elasticity) as well as improved thermal conduction that minimizes localized high temperatures zones in the body of the support structure 202. The liner 203 can have a uniform thickness across the interface surface 205 or possibly can have a non-uniform thickness across the interface surface 205 (for example, it can be contoured asymmetrically to provide thicker portions on the loaded side of the lobes of the interface surface 205 as compared to the unloaded side of the lobes of the interface surface 205). It is also contemplated that transition structures can be disposed between the support structure 202 and the liner 203. The liner 203 sealably engages the rotor of the Moineau device and is preferably realized by an elastomeric material. The material of the liner 203 is a resilient material such as an elastomer and can be a nanocomposite elastomer if desired. Note that the cross-section of FIG. 3 illustrates a stator with four lobes. Other multi-lobe configurations (typically from two to eight lobes) can be used.

The stator 200 is preferably formed by dispersing carbon nanotubes within a polymeric matrix by mixing to form the nanocomposite material. A bonding agent can be applied to the internal wall of the cylindrical casing 201. A mandrel (not shown) is coated with a thin liner 203. The coated mandrel is disposed within the cylindrical casing 201. The mandrel is preferably realized from steel or other suitable material. The coated mandrel is used as a male mold core for molding the nanocomposite support structure 202 to the coated mandrel. A release agent can be applied to the outer surface of the mandrel before it is coated with the liner 203. The release agent avoids bonding of the nanocomposite/liner structure to the mandrel. The nanocomposite material is added to the void between the coated mandrel and the cylindrical casing 201 and then cured to form the nanocomposite support structure 202. The mandrel is released from the liner 203 (and the underlying nanocomposite support structure 202) and then removed from inside the cylindrical casing 201. The material of the liner 203 is a resilient material such as an elastomer and can be a nanocomposite elastomer if desired.

Figure 4:
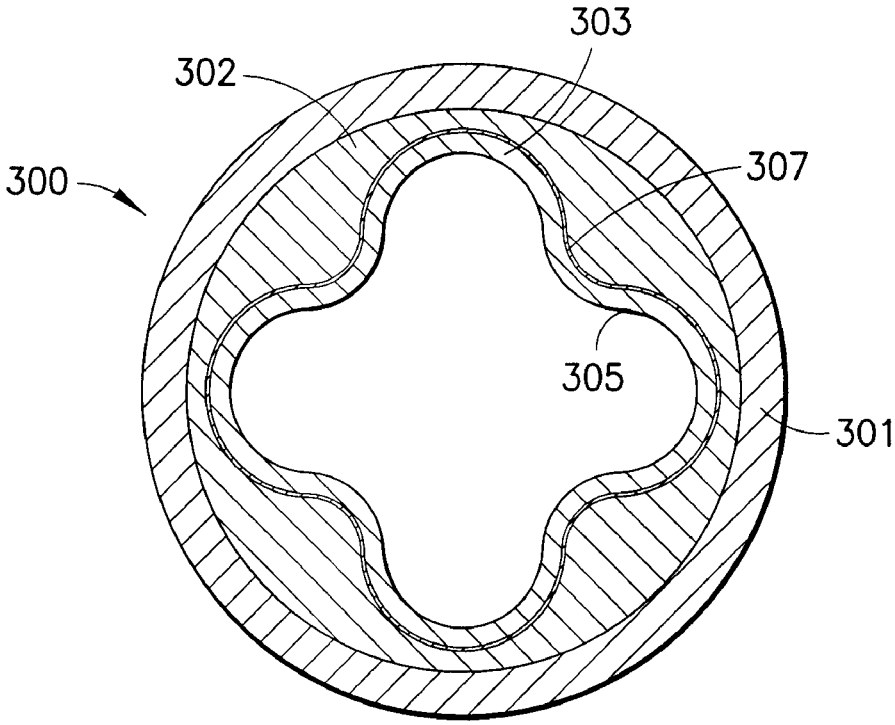
FIG. 4 is a cross-sectional view of yet another embodiment of the stator of the Moineau motor of FIG. 1 in accordance with the present invention.

FIG. 4 illustrates yet another embodiment of a stator 300 that includes a cylindrical casing 301, preferably realized from steel. A support structure 302, which is preferably realized from a nanocomposite material, is bonded to the cylindrical casing 301. The support structure 302 can also be realized from other materials, such as other molded polymers or metals. The support structure 302 has an undersized profiled helical support surface. A thin nanocomposite liner 303 is supported by the support structure 302 and defines the profiled helical inner surface 305 that sealably engages the profiled helical outer surface of the rotor (not shown) of the Moineau device. The support structure 302 reinforces the liner 303. When realized from a nanocomposite material, the support structure 302 provides improved mechanical properties (such as stiffness, tensile strength, visco-elasticity) as well as improved thermal conduction that minimizes localized high temperatures zones in the body of the structure 302. The liner 303 can have a uniform thickness across the interface surface 305 or possibly can have a non-uniform thickness across the interface surface 305 (for example, it can be contoured asymmetrically to provide thicker portions on the loaded side of the lobes of the interface 305 as compared to the unloaded side of the lobes of the interface 305). It is also contemplated that transition structures can be disposed between the support structure 302 and the liner 303. The liner 303 is preferably realized from carbon nanotubes that are dispersed and aligned in an ordered manner that increases the thermal conductivity of the liner 303. Such alignment is preferably realized by sandwiching the nanocomposite material of the liner 303 between a conductive film 307 and a conductive mandrel that defines the helical profile of the liner 303 (similar to that shown in FIG. 5). While curing the nanocomposite material of the liner 203, an electric field is created between the conductive film 307 and the mandrel by applying voltage signals thereto. The electric field aligns the carbon nanotubes of the liner 303 in an ordered manner. Such ordering is maintained in the cured state of the nanocomposite liner 203 and increases the thermal conductivity of the liner 303. The mandrel is released from the liner 305 and removed from inside the cylindrical casing 301. Note that the cross-section of FIG. 4 illustrates a stator with four lobes. Other multi-lobe configurations (typically from two to eight lobes) can be used.

Figure 5:
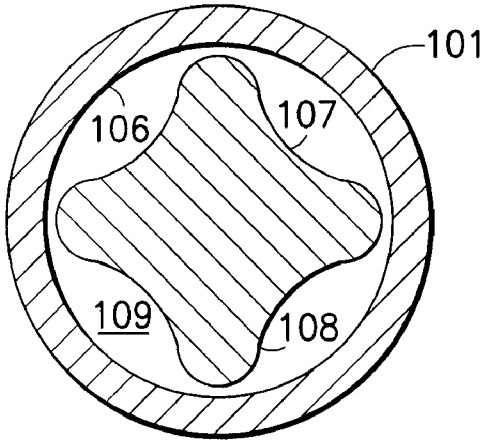
FIG. 5 is a cross-sectional view illustrating a method of manufacturing a stator of the Moineau motor of FIG. 1 in accordance with the present invention.

In alternate embodiments, it is possible to include a thin layer of metal (e.g., metallic foil) as the interface of the stator that sealably engages the rotor of the Moineau devices described herein. This configuration can be used with rotors that employ an elastomeric material for sealably engaging the interface of the stator. This configuration can be realized in conjunction with the manufacturing steps described above with respect to FIG. 5 by coating the mandrel 107 with the thin layer of metal. A release agent can be disposed between the metal coating and the mandrel. A bonding agent can be applied to the outer surface of the thin layer of metal. The metal-coated mandrel 107 is used as a male mold core. The nanocomposite is added to the void 109 between the metal-coated mandrel 107 and the cylindrical casing 101. When added to the void 109, the polymeric matrix of the nanocomposite can be in one of many phases (i.e., a liquid, paste, powder or granules). The nanocomposite is then cured to form the nanocomposite structure 103 and thereby impart the desired permanent helical profile to the nanocomposite structure 103 and the metal film is bonded to the nanocomposite structure 103. The mandrel 107 is then released from the metal film and removed from inside the cylindrical casing 101 to obtain the desired helical profiled metal film interface of the stator. Note that the cross-section of FIG. 5 illustrates a stator with four lobes. Other multi-lobe configurations (typically from two to eight lobes) can be used.

Figure 6:
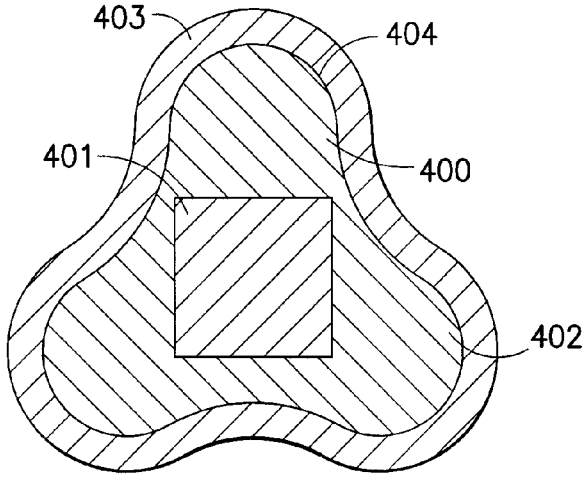
FIGS. 6 and 7 are cross-sectional views illustrating methods of manufacturing a rotor of a Moineau device in accordance with the present invention.
Figure 7:
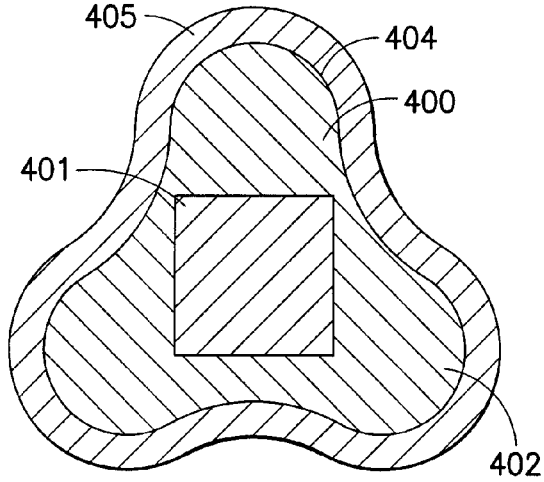
Figure 8:
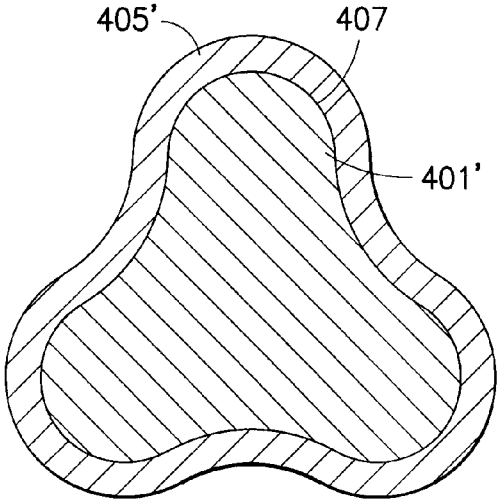
FIG. 8 is a cross-sectional view of another embodiment of a rotor of the Moineau motor of FIG. 1 in accordance with the present invention.

In yet other embodiments, the nanocomposite structures described herein can be employed as part of the rotor of a Moineau device and thus provide improved mechanical properties (such as stiffness, tensile strength, visco-elasticity) as well as improved thermal conduction that minimizes localized high temperatures zones in the rotor of the Moineau device. For example, FIG. 6 illustrates an embodiment of a rotor 400 that includes a central mandrel 401, preferably realized from steel. The central mandrel 401 is shown as having a generally square cross-section. Other non-rounded configurations (such as hexagonal or rectangular cross-sections) can be used. Such non-rounded configurations better transmit torque to the overlying structure. It is also contemplated that rounded configurations (circular or elliptical cross-sections) can also be used. A structure 402, which is realized from a nanocomposite material as described herein, is bonded to the mandrel 401. The structure 402 includes a profiled helical outer surface 404 formed by a helical profiled mold member 403 that surrounds the central member 401 and defines a void space therebetween. Carbon nanotubes are dispersed within a polymeric matrix by mixing to form the nanocomposite material. A bonding agent can be applied to the mandrel 402 and a release agent can be applied to the interior surface of the mold member 403. The nanocomposite material is added to this void space and cured to form the structure 402. The mandrel 401 and structure 402 are released from the mold member 403 and removed from inside the mold member 403. The structure 402 provides the profiled helical outer surface 404 that sealably engages the profiled helical inner surface of the stator of the Moineau device, which can be any of the stator embodiments described herein or other suitable stator. A resilient liner 405 can be coated on the helical structure 402 in order to provide a resilient interface to the stator of the Moineau device (FIG. 7). The resilient liner 405 can be realized from an elastomer and can also include carbon nanotubes dispersed therein if desired. The carbon nanotubes of the liner can be highly ordered for improved thermal conduction by applying an electric field to the nanocomposite material of the liner during the curing process. In another embodiment as shown in FIG. 8, a central mandrel 401' is provided with an undersized profiled helical outer surface 407. The mandrel 401' is preferably realized from metal, such as steel. The outer surface 407 is coated with a resilient liner 405'. A bonding agent can be applied to the outer surface 407 of the mandrel 401' to aid in bonding the resilient liner 405' to the mandrel 401'. The resilient liner 405' can be realized from an elastomer and can also include carbon nanotubes dispersed therein if desired. The resilient liner 405' can have a uniform thickness or possibly can have a non-uniform thickness (for example, it can be contoured asymmetrically to provide thicker portions on the loaded side of the lobes of the interface as compared to the unloaded side of the lobes of the interface). Note that the cross-sections of FIGS. 6, 7 and 8 illustrate a rotor with three lobes. Other multi-lobe configurations (typically from two to eight lobes) can be used.

Non-limiting examples of suitable bonding agents as described above include Cilbond™ line of bonding agents sold commercially by Chemical Innovations Limited of Lancashire, UK, the Chemlock™ line of bonding agents sold commercially by Lord Corporation of Cary, N.C., and the Chemosil™ line of bonding agents sold commercially by the Henkel Corporation of Dusseldorf, DE.

Non-limiting examples of suitable release agents as described above include the TraSys™ line of release agents sold commercially by E.I. du Pont de Nemours and Company of Wilmington, Del., and the Apticote™ 460M line of release agents sold commercially by Poeton Industries Limited of Gloucester, UK.

Additives can be added to the nanocomposite material to assist in binding the elastomer liners described above to the nanocomposite material. Non-limiting examples of such additives include zinc diacrylate (ZDA), zinc dimethacrylate (ZDMA), zinc monomethacrylate (ZMMA), the Duralink HTS™ line of additive sold commercially by Flexsys of Akron, Ohio, and the Ricobond 1731™ line and ZDA™ line of additive sold commercially by Sartomer Co. of Exton, Pa.

Similarly, an interlayer can be disposed between the support structures and elastomeric liners described above in order to assist in binding the elastomeric liners. Non-limiting examples of such interlayers include Poly BD 2035 thermoplastic polyurethane (TPU) resin sold commercially by Sartomer Co. of Exton, Pa.

There have been described and illustrated herein several embodiments of components of a Moineau device and methods of manufacturing same. While particular embodiments of the invention have been described, it is not intended that the invention be limited thereto, as it is intended that the invention be as broad in scope as the art will allow and that the specification be read likewise. Thus, while a particular Moineau motor configuration has been disclosed, it will be appreciated that the inventions described herein can be used for Moineau pumps as well. Furthermore, while the invention is described in relation to a Moineau motor for drilling a borehole, it will be understood that the invention can be used in Moineau devices for other applications. It will therefore be appreciated by those skilled in the art that yet other modifications could be made to the provided invention without deviating from its spirit and scope as claimed.

What is claimed is:

1. An apparatus for use with a fluid, comprising:

a stator with a profiled helical inner surface; and a rotor with a profiled helical outer surface that interfaces to said profiled helical inner surface of said stator to form cavities for the fluid between said stator and said rotor, said cavities progressing axially as said rotor is rotated relative to said stator, wherein at least one of said stator or said rotor comprises a nanocomposite material that includes a polymeric matrix with carbon nanotubes dispersed therein wherein the nanocomposite material improves thermal conductivity, the improved thermal conductivity inhibiting excessive build up of heat in said stator or said rotor.

2. An apparatus according to claim 1, wherein:

at least one of said stator and said rotor comprises a support structure that comprises said nanocomposite material.

3. An apparatus according to claim 2, wherein:

at least one of said stator and said rotor comprises a resilient liner bonded to said support structure, said resilient liner providing an interface between said stator and said rotor.

4. An apparatus according to claim 1, wherein:

at least one of said stator and said rotor comprises a resilient liner providing an interface between said stator and said rotor, wherein said liner comprises said nanocomposite material.

5. An apparatus according to claim 4, wherein:

said carbon nanotubes of said nanocomposite material are aligned in an ordered manner.

6. An apparatus according to claim 5 wherein the ordered manner increases a thermal conductivity of the liner.

7. An apparatus according to claim 1, wherein:

said polymeric matrix comprises at least one elastomer.

8. An apparatus according to claim 1, wherein:

said polymeric matrix comprises at least one thermoplastic elastomer.

9. An apparatus according to claim 1, wherein:

said polymeric matrix comprises at least one thermoplastic material.

10. An apparatus according to claim 1, wherein:

said polymeric matrix comprises at least one thermoset material.

11. An apparatus according to claim 1, wherein:

said polymeric matrix comprises at least one additive dispersed therein, the additive selected from the group including a filler, a plasticizer, and fibers.

12. An apparatus according to claim 1, wherein:

said stator includes said nanocomposite material.

13. An apparatus according to claim 1, wherein:

said rotor includes a central mandrel with a profiled helical outer surface and a molded polymeric support structure bonded thereto, said molded polymeric support structure including a first nanocomposite material that includes a polymeric matrix with carbon nanotubes dispersed therein.

14. An apparatus according to claim 13, wherein:

said rotor further comprises a resilient liner formed on said molded polymeric support structure.

15. An apparatus according to claim 14, wherein:

said resilient liner comprises a second nanocomposite material that includes an elastomer with carbon nanotubes dispersed therein.

16. An apparatus according to claim 1, wherein:

said rotor includes a central mandrel with a profiled helical outer surface coated with a resilient liner, said resilient liner comprising a nanocomposite material that includes an elastomer with carbon nanotubes dispersed therein.

17. An apparatus according to claim 1 wherein the nanocomposite material comprises about 2% to 40% by weight of carbon nanotubes.

* * * * *